US008261605B2

(12) United States Patent
Hermes et al.

(10) Patent No.: US 8,261,605 B2
(45) Date of Patent: Sep. 11, 2012

(54) METHOD AND DEVICE FOR CONTROLLING A FUEL METERING SYSTEM

(75) Inventors: Henning Hermes, Wolfach (DE); Traugott Degler, Korntal (DE); Andreas Hempel, Ludwigsburg (DE); Andreas Sommerer, Kernen (DE); Jens-Uwe Nagler, Stuttgart (DE); Marcus Marheineke, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 69 days.

(21) Appl. No.: 12/933,933

(22) PCT Filed: Mar. 23, 2009

(86) PCT No.: PCT/EP2009/053375
§ 371 (c)(1),
(2), (4) Date: Sep. 22, 2010

(87) PCT Pub. No.: WO2009/121746
PCT Pub. Date: Oct. 8, 2009

(65) Prior Publication Data

US 2011/0016959 A1 Jan. 27, 2011

(30) Foreign Application Priority Data

Apr. 3, 2008 (DE) ..... 10 2008 000 983

(51) Int. Cl.
*G01M 15/09* (2006.01)

(52) U.S. Cl. ..... 73/114.51

(58) Field of Classification Search ..... 73/114.51
See application file for complete search history.

(56) References Cited

U.S. PATENT DOCUMENTS

| | | | | |
|---|---|---|---|---|
| 6,712,047 | B2 * | 3/2004 | Rueger | 123/479 |
| 6,912,983 | B2 * | 7/2005 | Okamoto et al. | 123/179.16 |
| 7,185,828 | B2 * | 3/2007 | Igashira et al. | 239/88 |
| 7,305,971 | B2 * | 12/2007 | Fujii | 123/479 |
| 2003/0154806 | A1 * | 8/2003 | Rueger | 73/865.9 |
| 2007/0028895 | A1 * | 2/2007 | Fujii | 123/446 |

FOREIGN PATENT DOCUMENTS

| | | |
|---|---|---|
| DE | 196 26 689 | 11/1997 |
| DE | 198 00 760 | 8/1998 |
| DE | 10 2005 053405 | 5/2007 |
| DE | 10 2006 027665 | 9/2007 |
| EP | 2 014 900 | 1/2009 |
| FR | 2 866 390 | 8/2005 |
| JP | 2003 278586 | 10/2003 |
| WO | 01/73282 | 10/2001 |

* cited by examiner

*Primary Examiner* — Freddie Kirkland, III
(74) *Attorney, Agent, or Firm* — Kenyon & Kenyon LLP

(57) ABSTRACT

A method and a device for controlling a fuel metering system are described. The fuel metering system includes at least one injector for injecting fuel into an internal combustion engine. An electric current value is applied to the at least one injector, and a rail pressure value is determined based on the electric current value.

20 Claims, 4 Drawing Sheets

METHOD AND DEVICE FOR CONTROLLING A FUEL METERING SYSTEM

FIELD OF THE INVENTION

The present invention is directed to a device and a method for controlling a fuel metering system.

BACKGROUND INFORMATION

German patent document DE 196 26 689 discusses a method and a device for monitoring an injection system. It discusses a so-called common rail system, in which at least one injector injects fuel from a high-pressure area into a combustion chamber of an internal combustion engine. The pressure in the high-pressure area is controllable via at least one actuator. In addition, a sensor via which the pressure in the high-pressure area is detected is usually provided. The pressure in the high-pressure area is detected against the background of the rail pressure, as the pressure in the high-pressure area is also referred to, being regulated at a predefined level. Furthermore, the rail pressure is required to implement an accurate metering of fuel.

In the event of a failure of this rail pressure sensor, suitable measures must usually be implemented. If such an error occurs, the high-pressure pump is usually put in a "full delivery" mode. Therefore, an excess pressure is usually established in the high-pressure area. This excess pressure results in the opening of a pressure-limiting valve, which opens a connection to the low-pressure area when a certain rail pressure is exceeded in the high-pressure area. The opening pressure of the pressure-limiting valve is typically 200 to 400 bar above the maximum system pressure. After opening the pressure-limiting valve, a rail pressure of approximately 700 bar is established virtually independently of the delivery rate of the high-pressure pump. The entire injection system, even without a rail pressure sensor, is thus in a defined state and is available for emergency operation.

In certain operating states or when there is a defect in the pressure-limiting valve, it may occur that this pressure-limiting valve does not open. This results in an increased rail pressure. Such an increased rail pressure may in turn result in damage to the injector in particular.

SUMMARY OF THE INVENTION

The rail pressure is an important variable required for controlling the internal combustion engine. It is therefore advantageous if another rail pressure signal is available in addition to the output signal of the rail pressure sensor.

An additional rail pressure signal is available since the rail pressure value is determined on the basis of the electric current value applied to at least one injector. This may be used for a plausibility check of the signal of the rail pressure sensor and/or as a default value in the event of a defect in the rail pressure sensor.

According to the exemplary embodiments and/or exemplary methods of the present invention, it has been recognized that the electric current value at which the injector enables the injection correlates with the rail pressure. In a particularly advantageous embodiment of the present invention, a check as to whether an injection has occurred is performed. This yields the value for the rail pressure as a function of whether an injection has occurred and of the electric current value at which the injector is triggered.

In a first specific embodiment, the electric current value applied to the injector is varied, in particular being increased until an injection occurs. The rail pressure is then determined based on the electric current value at which an injection occurs.

In a second specific embodiment, the electric current value applied to the injector is therefore varied, in particular reduced, based on an electric current value at which an injection occurs, until no injection occurs. The rail pressure is then determined based on the electric current value at which no injection occurs.

In a further specific embodiment, an actuator is triggered for controlling the fuel pressure in the case of a detected defect in a rail pressure sensor so that the rail pressure rises. Furthermore, the injector is triggered at a reduced electric current value. A check is performed as to whether an injection has occurred and depending on the check, emergency operation is initiated. This procedure allows reliable error detection, in particular of the pressure-limiting valve. Furthermore, reliable emergency operation is made possible. With the procedure according to the present invention, it is possible to recognize reliably whether the system is operating at a rail pressure of approximately 700 bar and whether the pressure-limiting valve has opened.

This recognition of the prevailing status of the pressure-limiting valve and/or the value of the prevailing rail pressure may then be used as the basis for deciding whether emergency operation is possible or whether the engine must be stopped. Without the option of the indirect determination of the pressure level described above in the event of an error in the rail pressure sensor, an individual calibration of the system using limit patterns would be necessary.

It is advantageous in particular that the estimate for the rail pressure thereby ascertained may be used for other purposes. For example, the estimate for the rail pressure may be used to control the internal combustion engine.

Only in this way could the possible range for emergency operation be determined. In addition to the project-specific extra expenditure for the calibration and the limit patterns, emergency operation would be extremely limited and would not detect the driving state but instead would be based only on a worst-case analysis of the system.

It is advantageous in particular if the measure is performed only when the rail pressure sensor is recognized as being defective. It is even possible to ascertain the estimate independently of whether the rail pressure sensor has been recognized as being defective.

Emergency operation is advantageously initiated when no injection occurs. The occurrence of an injection indicates that the pressure has not dropped because the pressure-limiting valve has not opened. The occurrence of an injection may be detected reliably and with little effort. Detection of the occurrence of an injection in a particularly simple manner is possible on the basis of a rotational speed signal because the rotational speed signal is usually already present in the control unit used.

Exemplary embodiments of the present invention are depicted in the drawings and explained in greater detail in the following description.

DETAILED DESCRIPTION

Figure 1:
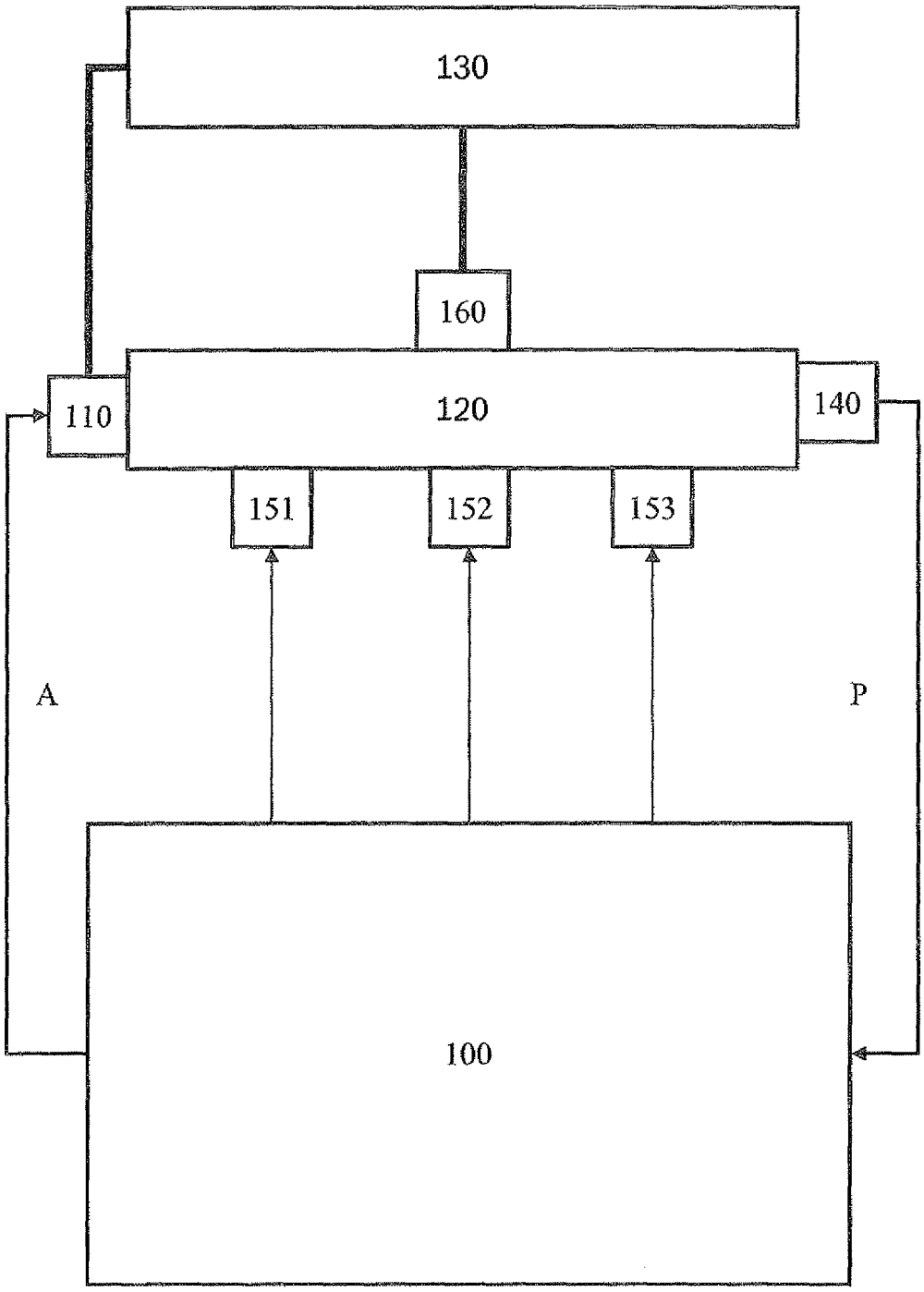
FIG. 1 shows a block diagram of the essential elements of a fuel metering system.

FIG. 1 shows the essential elements of a fuel metering system in the form of a block diagram. A control unit is labeled as 100. It controls an actuator 110 for controlling fuel pressure P via a triggering signal A. The exemplary embodiment shown here is a so-called pressure regulating valve, connecting a high-pressure area 120 to a low-pressure area 130. Furthermore, actuator 110 may be designed as a controllable high-pressure pump. In this case, the high-pressure pump delivers fuel from low-pressure area 130 to high-pressure area 120. The quantity delivered and thus the pressure in the high-pressure area may be controlled through appropriate triggering of an electromagnetic valve.

A sensor 140 detects the instantaneous value of the pressure in the high-pressure area which is also referred to below as rail pressure P. Sensor 140 is also referred to below as the rail pressure sensor. An appropriate signal of sensor 140 goes to control unit 100. Depending on the various additional signals (not shown), the control unit calculates the triggering signals for activating injectors 151, 152 and 153. These injectors meter a certain quantity of fuel to the internal combustion engine at a certain point in time, depending on the particular triggering signal. The figure shows only three injectors and three cylinders. The procedure according to the exemplary embodiments and/or exemplary methods of the present invention may be used with any number of cylinders.

In addition, a pressure-limiting valve 160 is provided, connecting high-pressure area 120 to low-pressure area 130. In the normal case, this valve is closed and the connection is interrupted. If the pressure in high-pressure area 120 rises above a certain level, pressure-limiting valve 160 opens and the pressure in the high-pressure area drops to a certain level.

Due to the drop in the injector current level, i.e., the electric current value applied to injectors 151 and 153, the opening magnetic force, and thus the injection quantity may be reduced. There is an electric current value at which the opening force and the closing forces are in balance. In other words, the hydraulic force, which is determined essentially by the rail pressure, and the magnetic force, which is determined essentially by the electric current, and the spring force, which is applied by a spring installed in the injector, are in balance. No injection occurs if the electric current drops below this limiting current value, i.e., the electric current through the injector drops to a lower level. The change in quantity resulting from this drop in electric current, in particular the failure of injection to occur, is detectable on the basis of the rotational speed signal.

According to the exemplary embodiments and/or exemplary methods of the present invention, the following procedure is now provided. When a fault is detected in rail pressure sensor 140, actuator 110 is triggered so that the rail pressure increases. It is provided that the high-pressure pump is triggered in particular, so that it delivers the maximum possible quantity. This results in opening of pressure-limiting valve 160. In other words, after a certain waiting time after full delivery by the high-pressure pump, the injector(s) is (are) triggered at a reduced electric current value. If an injection occurs, a rail pressure above the value, which usually occurs with the pressure-limiting valve opened, is detected. In other words, it is recognized that the pressure-limiting valve has not opened. In this case, no emergency operation is possible and the internal combustion engine is shut down. If no injection occurs, i.e., the rotational speed drops, this means that the pressure-limiting valve has opened and the internal combustion engine may be operated further in emergency operation.

This means that if injection occurs, a value greater than the value at which the pressure-limiting valve opens is used as the estimate for the rail pressure. If no injection occurs, a value which usually prevails when the pressure-limiting valve is opened is used as the estimate for the rail pressure. This value may be in the range of 600 to 800 bar.

This procedure is diagramed in greater detail in FIG. 2 below. In a first step 200, a defective rail pressure sensor is detected. In the related art, various procedures by which such a defective rail pressure sensor may be detected are known. For example, it is possible to provide for a check as to whether the rail pressure signal is outside of certain value ranges. If such an error is detected, actuator 110 is triggered at the same time so that the pressure rises. Query 210 checks as to whether a certain waiting time has elapsed. If this is not the case, query 210 occurs again. If the waiting time has elapsed, step 220 follows. This waiting time is sufficient for the pressure to rise and the pressure-limiting valve to have opened. In step 220, a reduced electric current is applied to the injectors. This electric current is selected in such a way that it remains closed in operation with an opened pressure-limiting valve and opens at an elevated rail pressure. In other words, the electric current value is selected in such a way that the valve remains closed at a reduced rail pressure of less than 1000 bar and no injection occurs, and an injection occurs at a conventional rail pressure of more than 1500 bar, which is in the normal range. Subsequent query 230 checks as to whether the rotational speed of the internal combustion engine has dropped since the triggering of the injector at a reduced electric current. If this is the case, then in step 240 it is recognized that the rail pressure has dropped and that the pressure-limiting valve has opened. In this case, emergency operation is initiated in step 240. Furthermore, a value which usually occurs when the pressure-limiting valve is opened is used as the estimate for the rail pressure. This value may be in the range of 700 bar. However, if query 230 recognizes that there has not been a drop in rotational speed, i.e., injection is still taking place, it is concluded from this that the pressure has not dropped and that the pressure-limiting valve has not opened. In this case, the internal combustion engine is shut down in step 250. Furthermore, a value greater than the value at which the pressure-limiting valve is opened is used for the rail pressure.

This means that when there is a substantial error in the rail pressure sensor, actuator 110 is triggered in such a way that the rail pressure rises. After a waiting time has elapsed, the injectors are triggered at a reduced electric current value. Depending on whether an injection has occurred, emergency operation or a shutdown of the internal combustion engine is triggered. This measure is taken in particular when a rail pressure sensor is defective. The occurrence or non-occurrence of an injection is detected on the basis of the rotational speed signal. Emergency operation may be initiated when there is no injection in the case of a reduced electric current value. The internal combustion engine is shut down when an injection takes place at a reduced electric current value.

Figure 2:
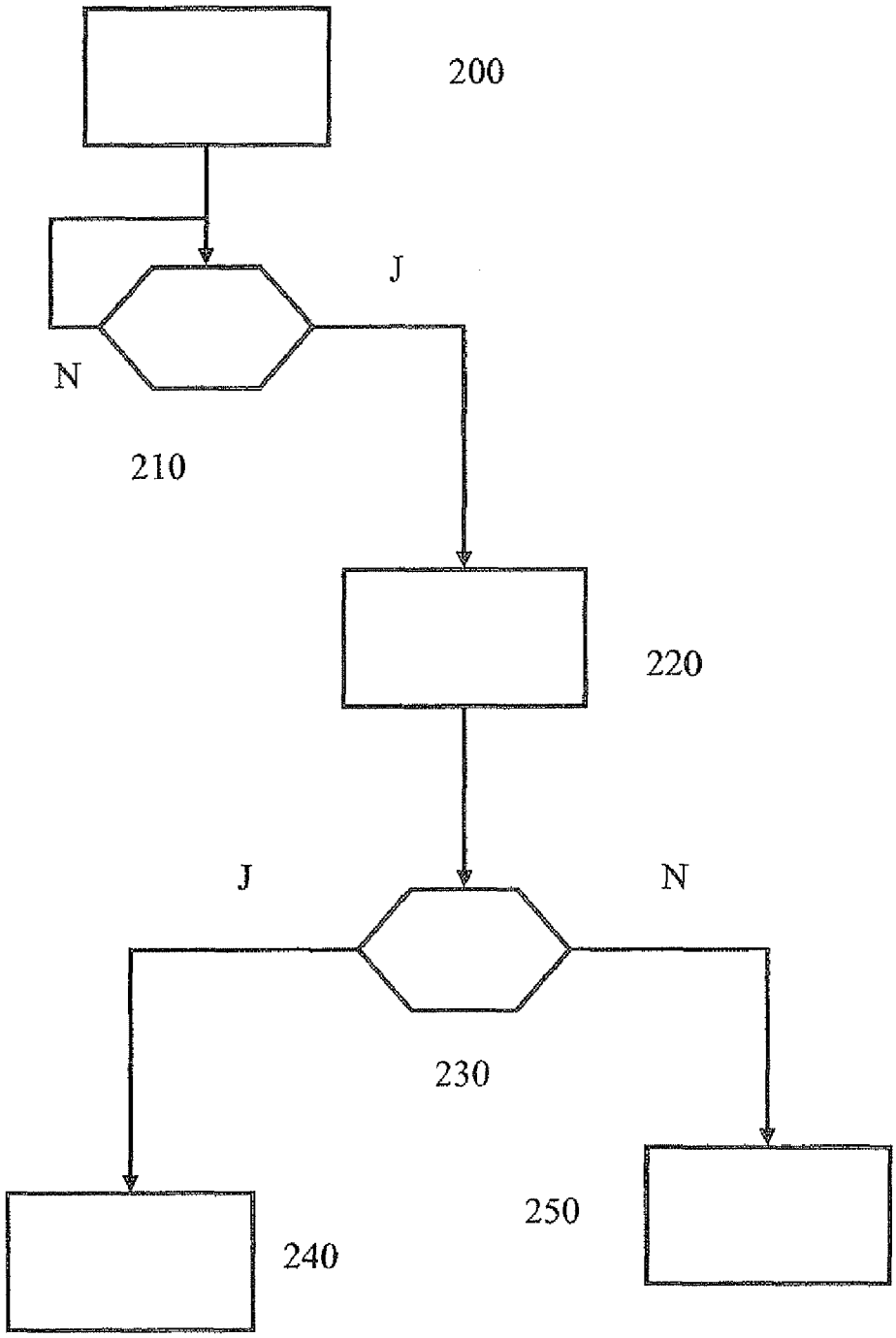
FIG. 2 shows a flow chart of the procedure according to the present invention.

FIG. 2 illustrates a special specific embodiment of the present invention. According to the exemplary embodiments and/or exemplary methods of the present invention, it has been recognized that the rail pressure value may be deduced from the electric current value which is applied to the solenoid valve injector. This is based on the finding that the magnetic force operates against a hydraulic pressure, which depends on the rail pressure. This means that the rail pressure is deduced based on the electric current value at which the injector enables the injection. An additional rail pressure signal is therefore available and may be used for a plausibility check of the signal of the rail pressure sensor and/or as a substitute value in the event of a defect in the rail pressure sensor. A check is performed as to whether an injection has occurred. The value for the rail pressure is obtained as a function of whether there has been an injection and of the electric current value with which the injector is triggered.

In a first specific embodiment, the value of the electric current applied to the injector is varied, in particular increased, based on an electric current value at which no injection occurs, until an injection occurs. The rail pressure is then determined based on the electric current value at which an injection occurs.

In a second specific embodiment, the electric current value applied to the injector is varied, in particular reduced, based on an electric current value at which an injection occurs, until no injection occurs. The rail pressure is then determined based on the electric current value at which no injection occurs.

Figure 3:
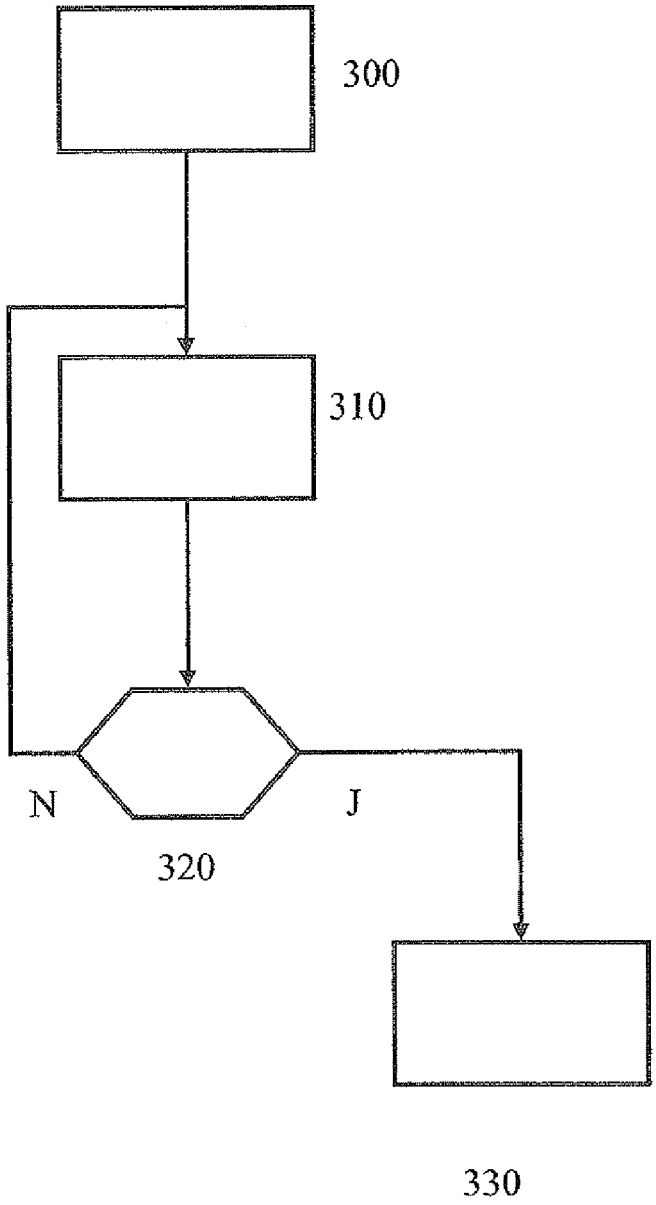
FIG. 3 shows a flow chart of an embodiment of the procedure according to the present invention.

FIG. 3 shows a specific embodiment of the procedure according to the present invention. In a first step 300, an operating state in which it is possible and/or necessary to ascertain the rail pressure is detected. If this is the case, then in step 300, the electric current value at which the injector is triggered is set at a starting value. This starting value is selected, for example, so that no injection occurs.

In a subsequent step 310, the starting value is increased by a small value. A subsequent query 320 checks as to whether an injection has occurred. If this not the case, step 310 is performed again. Detection of an injection may be performed based on the rotational speed signal.

If the occurrence of an injection is detected, then in step 330 the rail pressure is determined based on the instantaneous electric current value at which an injection has occurred for the first time after an increase. This takes place, for example, by reading out the rail pressure, depending on the electric current value, from a characteristic line or an engine characteristics map. An engine characteristics map is used if other variables are also used in determining the rail pressure.

One injector is usually allocated to each cylinder of the internal combustion engine. The procedure according to the present invention may be implemented with all injectors, a subset of injectors, or only one injector.

If the method is executed in ongoing operation, then the missing injections result in acoustic irregularities and interfering noises due to the drop in the injector current. Therefore, the electric current value may be lowered from a value at which injections occur to a value at which injections do not occur.

To reduce this unwanted noise, one of the two following measures may be implemented as particularly advantageous embodiments.

A noise-optimized injection pattern is used in these two measures, and the drop in current occurs only in a partial injection, which does not have any significant influence on the noise emissions.

For example, it is possible to provide for the preinjection to be divided into two partial injections. Furthermore, the injection center of distribution is shifted toward retardation. The triggering current is also lowered with only one partial injection of the two preinjections. The drop in electric current may occur in the second of the two preinjections. Failure of the second preinjection is unremarkable with regard to noise because the first preinjection is still occurring. However, the missing amount may be detected on the basis of the resulting torque deficit.

Alternatively, it is possible to provide for the main injection to be divided into two partial injections. The triggering current is reduced in the remaining course in only one partial injection of the two main injections. The drop in electric current may occur in the second of the two main injections. The rise in pressure in the cylinder, which dominates the sound pattern, is sustained undisturbed. If the second main injection is eliminated, only the rear portion of the cylinder pressure curve is omitted.

Figure 4:
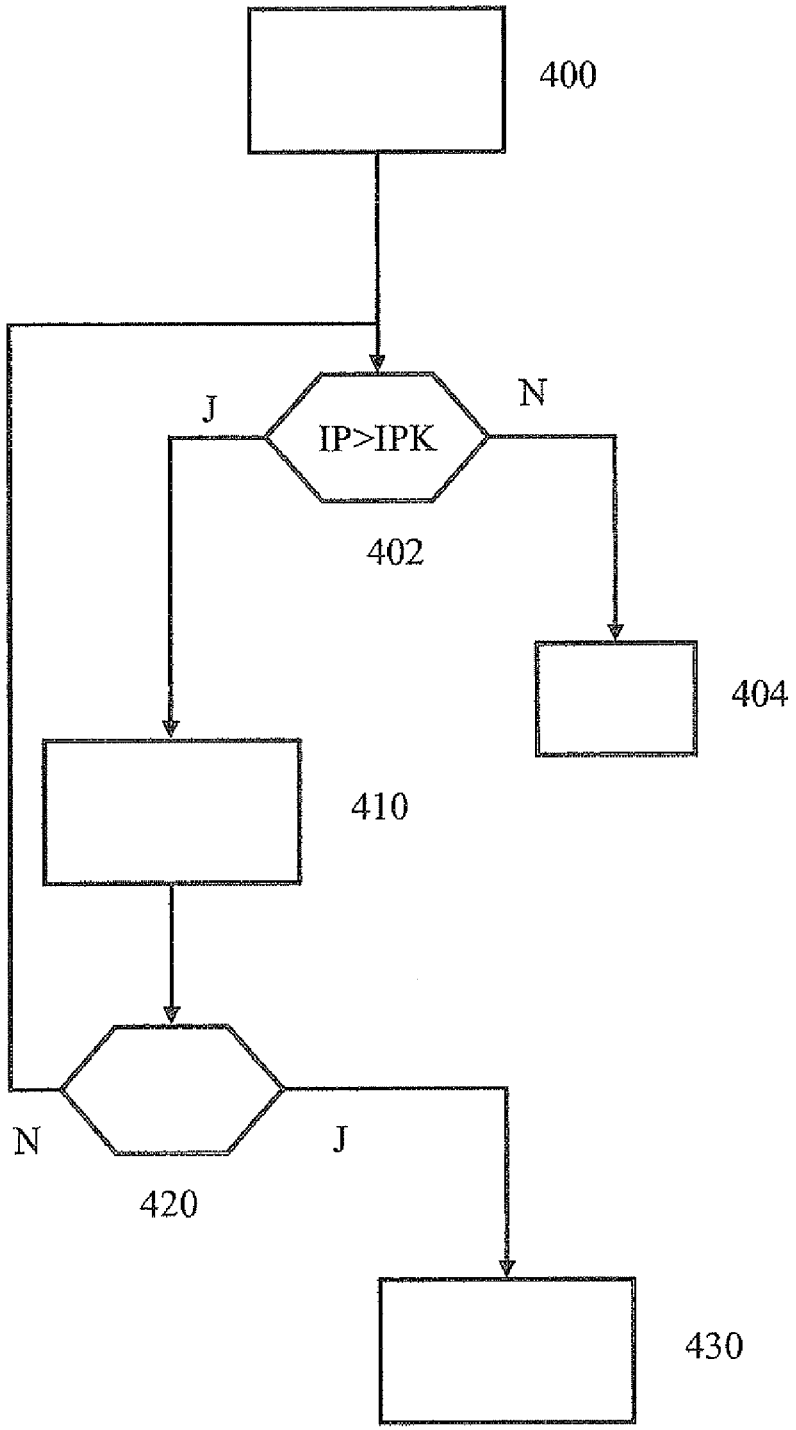
FIG. 4 shows a flow chart of another embodiment of the procedure according to the present invention.

FIG. 4 shows another specific embodiment of the procedure according to the present invention. In a first step 400, an operating state in which it is possible and/or necessary to ascertain the rail pressure is detected. If this is the case, then in step 400, the electric current value at which the injector is triggered is set at a starting value. This starting value is selected, for example, so that an injection occurs.

Subsequent query 402 checks as to whether electric current value IP at which the injector is triggered is greater than a critical electric current value IPK. This critical electric current value corresponds to the electric current value at which an injection is still possible at the corresponding rail pressure. If query 402 detects that the electric current value is lower than the critical electric current value, the program ends at step 404 and the result is that the rail pressure signal and the electric current value are plausible.

If electric current value IP is not smaller than critical electric current value IPK, step 410 is performed again.

In step 410, the starting value is reduced by a small value. The critical electric current value is selected in such a way that an injection still occurs with the next triggering at the correct pressure value.

Subsequent query 420 checks as to whether an injection has occurred. If this is the case, then step 402 is performed again. The detection of an injection may take place via the rotational speed signal.

If lack of an injection is detected, it is recognized in step 430 that the rail pressure sensor has indicated a value which is too high.

The procedure described below allows a plausibility check on the pressure value to the extent that the rail pressure sensor displays values that are too small. This means that the rail pressure sensor, displaying a signal which is too low, is indicated by an opening pressure-limiting valve. This procedure is advantageous in the case of systems having pressure-limiting valves. A plausibility check is always performed on the rail pressure sensor when currents are above this critical electric current value. This ensures that the actual rail pressure is always greater than or equal to the pressure value belonging to critical electric current value IPK. A "downward" plausibility check is thus ensured. Failure of an injection occurs only for the error case when the rail pressure sensor indicates a pressure which is too high.

In this embodiment, it is provided according to the exemplary embodiments and/or exemplary methods of the present invention that the electric current value at which the injector is triggered is selected in such a way that an injection always occurs in error-free operation.

The error case when the rail pressure sensor indicates a pressure which is too low is detected by the pressure-limiting valve. If the physical pressure is far above the value indicated by the rail pressure sensor according to this, then the pressure-limiting valve opens in operating states having high rail pressure setpoint values. The opening of the pressure-limiting valve is indicated by a corresponding function. Opening of the pressure-limiting valve in operating states having a high setpoint value for the rail pressure is interpreted as an error in the rail pressure sensor.

A change in the sound of the internal combustion engine occurs only when the plausibility check has detected an error. In error-free operation, there are no additional noise emissions.

What is claimed is:

1. A method for controlling a fuel metering system, comprising:

injecting fuel into an internal combustion engine by at least one injector, wherein an electric current value is applied to the at least one injector;

performing a plausibility check of a signal of a rail pressure sensor;

triggering an actuator to control the fuel pressure when a defect in the rail pressure sensor is detected, so that rail pressure rises so as to trigger at least one injector to perform at a reduced electric current value;

performing a query to determine if a sufficient waiting time has elapsed before applying the reduced electric current value; and determining a rail pressure value based on at least the electric current value.

2. The method of claim 1, further comprising:

checking whether an injection has occurred, wherein a certain electric current value is applied to the at least one injector; and depending on a result of the checking and the electric current value, determining a value for the rail pressure.

3. The method of claim 2, wherein the electric current value is selected so that an injection always occurs in error-free operation.

4. The method of claim 1, further comprising:

varying the electric current value based on an electric current value at which no injection occurs; and checking whether an injection has occurred;

wherein the value for the rail pressure is determined based on the electric current value at which an injection occurs.

5. The method of claim 1, further comprising:

varying the electric current value based on an electric current value at which an injection occurs; and checking whether an injection has occurred;

wherein the value for the rail pressure is determined based on the electric current value at which no injection occurs.

6. The method of claim 1, further comprising:

checking whether an injection has occurred; and initiating an emergency operation as a function of at least one of a result of the checking and determining an estimate for the rail pressure.

7. The method of claim 6, wherein the actuator is triggered so that the rail pressure rises.

8. The method of claim 6, wherein emergency operation is initiated when no injection occurs.

9. The method of claim 6, wherein the reduced electric current value is selected so that an injection occurs at a normal rail pressure and so that no injection occurs at a reduced rail pressure.

10. The method of claim 6, wherein the reduced electric current value is selected so that an injection occurs at a normal rail pressure and so that no injection occurs when the pressure-limiting valve is opened.

11. The method of claim 6, wherein the actuator is triggered so that the rail pressure rises, and wherein emergency operation is initiated when no injection occurs.

12. The method of claim 11, wherein an injection is detected based on a rotational speed signal.

13. The method of claim 6, wherein the reduced electric current value is selected so that an injection occurs at a normal rail pressure and so that no injection occurs at a reduced rail pressure, and wherein a noise-optimized injection pattern is used.

14. The method of claim 6, wherein the reduced electric current value is selected so that an injection occurs at a normal rail pressure and so that no injection occurs when the pressure-limiting valve is opened, and wherein a noise-optimized injection pattern is used.

15. The method of claim 1, wherein an injection is detected based on a rotational speed signal.

16. The method of claim 1, wherein a noise-optimized injection pattern is used.

17. The method of claim 1, wherein the electric current is reduced only in the case of a partial injection.

18. The method of claim 1, wherein a noise-optimized injection pattern is used, and wherein the electric current is reduced only in the case of a partial injection.

19. A device for controlling a fuel metering system, comprising:

at least one injector for injecting fuel into an internal combustion engine;

an actuator to control the fuel pressure when a defect in a rail pressure sensor is detected;

an arrangement to perform a query to determine if a sufficient waiting time has elapsed before applying an electric current value;

an arrangement to apply the electric current value to the at least one injector; and a determining arrangement to determine a rail pressure value based on at least the electric current value.

20. The device of claim 19, further comprising:

a checking arrangement to perform a plausibility check for the detect in the rail pressure sensor.

* * * * *